United States Patent [19]

Fujita et al.

[11] 4,276,631

[45] Jun. 30, 1981

[54] ELECTRONIC TIMER

[75] Inventors: Teizo Fujita, Ibaraki; Toshiro Ohashi, Ikeda; Kouji Takimoto, Kobe, all of Japan

[73] Assignee: Izumi Denki Corporation, Osaka, Japan

[21] Appl. No.: 892,709

[22] Filed: Apr. 3, 1978

[51] Int. Cl.[3] ..... G04F 3/00

[52] U.S. Cl. ..... 368/89; 368/107; 368/108; 361/195; 361/202; 361/400

[58] Field of Search ..... 335/267, 268, 199; 361/195, 202, 400, 397–413; 307/141, 141.4, 141.8; 58/21.13; 368/89, 107, 108

[56] References Cited

U.S. PATENT DOCUMENTS

| | | | |
|---|---|---|---|
| 2,999,191 | 9/1961 | Muradian et al. | 361/195 |
| 3,099,758 | 7/1963 | Pieczynski | 307/141.8 |
| 3,134,986 | 6/1964 | Gelhar | 361/195 X |
| 3,142,784 | 7/1964 | Bloomfield | 361/400 X |
| 3,204,060 | 8/1965 | Mentzer | 335/199 X |
| 3,339,117 | 8/1967 | Fisher | 361/400 |
| 3,475,657 | 10/1969 | Knowles | 361/413 |
| 3,800,257 | 3/1974 | Schmitt | 335/267 X |

*Primary Examiner*—Ulysses Weldon

*Attorney, Agent, or Firm*—Pollock, Vande Sande & Priddy

[57] ABSTRACT

An electronic timer having two electromagnetic relays is disclosed. The two electromagnetic relays are mounted on an insulating base plate. The electronic timer further comprises a delay circuit. At least one of the two electromagnetic relays is connected to an external power supply through the delay circuit. These two electromagnetic relays may be connected in such a manner that when connected with an external power supply, one of them is operated instantaneously while the other is actuated after a delay time, or in such a manner that both of them are simultaneously operated after a predetermined delay time, or in such a manner that they are operated after different delay times.

7 Claims, 8 Drawing Figures

ELECTRONIC TIMER

BACKGROUND OF THE INVENTION

This invention relates to an electronic timer, or more in particular to an electronic timer comprising a delay circuit and two electromagnetic relays mounted on a common base plate carrying output terminals of the relays and a couple of power supply terminals.

In conventional electronic timers, the timer proper and the relays are constructed separately and used by combining them, resulting in a large space occupied by them. Even those conventional timers in which the timer and the relays are incorporated in a single construction have the disadvantages of complex structure and bulkiness.

SUMMARY OF THE INVENTION

An object of the present invention is to provide a compact electronic timer with a simple construction having no shortcomings as mentioned above.

According to the present invention, there is provided an electronic timer comprising two electromagnetic relays, an insulating base plate on which the electromagnetic relays are mounted, and a delay circuit. At least one of the two electromagnetic relays is connected to an external power supply through the delay circuit. These two electromagnetic relays may be connected in such a manner that when connected with an external power supply, one of them is actuated instantaneously and the other after a timing, or in such a manner that both of them are simultaneously actuated after a predetermined delay time, or in such a manner that they are actuated after different delay times.

BRIEF DESCRIPTION OF THE DRAWINGS

The present invention will be described below with reference to the accompanying drawings, wherein.

DESCRIPTION OF THE PREFERRED EMBODIMENTS

Figure 1:
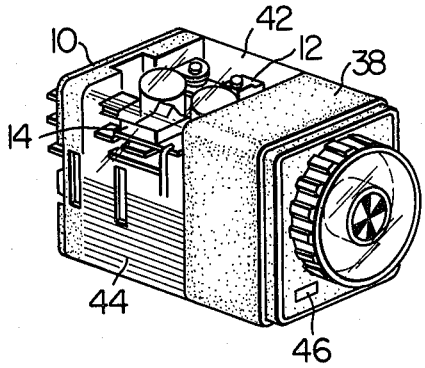
FIG. 1 is a perspective view of an embodiment of the present invention of the pointer timing setting type.
Figure 2:
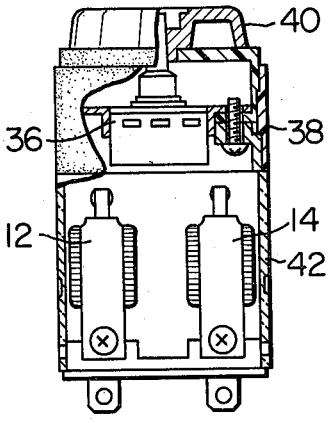
FIG. 2 is a rear view, partially cut away, of the embodiment of FIG. 1.

Referring to the drawings, two single-pole electromagnetic relays 12 and 14 are arranged in the same orientation and secured in spaced relation with each other on an insulating base 10. The base 10 is provided on the underside thereof with two sets of output terminals $a_1$, $b_1$, $c_1$; and $a_2$, $b_2$, $c_2$ for the relays 12 and 14 respectively, and power terminals 16 and 18 connected to an external power supply. The relays 12 and 14 have exciting coils 20 and 22 respectively. Each of the relays 12 and 14 also includes two fixed contacts and a contact movably supported between the two fixed contacts. A movable contactor for carrying the movable contact of the relay 12 is designated by reference numeral 24, and that for carrying the movable contact of the relay 14 by numeral 26. The two fixed contacts of the relay 12 are connected to terminals $a_1$ and $b_1$ respectively, while the movable contact thereof is connected to the terminal $c_1$. The two fixed contacts of the relay 14, on the other hand, are connected to terminals $a_2$ and $b_2$ respectively while the movable contact thereof to the terminal $c_2$.

All or substantially all electrical/electronic parts 30 constituting the delay circuit 28 are mounted on a printed base 31 which is securely erected on the base 10 on the side opposite to the contact means of the two relays 12 and 14 with respect to the respective exciting coils 20 and 22. Among the electronic parts, comparatively large parts such as capacitors 34 are located in the space available between the relays 12 and 14.

Reference numeral 36 shows a timing-regulating variable resistor which is fixed on an upper casing 38, so that the timing may be regulated by turning a knob positioned on the upper surface of the upper casing 38.

The upper casing 38 is stacked on an outer casing 42 of the base 10. The upper casing 38 is made of opaque material, while the outer casing 42 is preferably made of transparent material so that the operation of the contacts of the relays 12 and 14 inside may be observed from outside of the casing 42. No observation is required, however, from outside the walls on three sides of the outer casing 42 facing the coils 20 and 22 and the printed base 32 and hence these three walls may be appropriately provided with serration 44 to make the inside parts in that section substantially invisible in the view point of design.

Figure 5A:
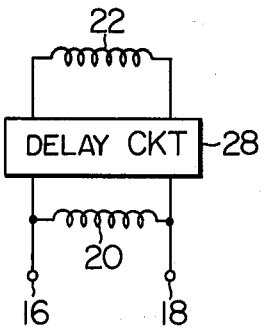
FIGS. 5A, 5B and 5C show different wiring diagrams of the embodiment of FIG. 1.

In the above-mentioned construction according to the present invention, as shown in FIG. 5A, the ends of the exciting coil 20 of the relay 12 may be directly connected to the power supply terminals 16 and 18 may be connected, while the ends of the exciting coil 22 of the relay 14 are connected to the same power supply terminals 16 and 18 through the delay circuit 28, so that the output terminals $a_1$, $b_1$ and $c_1$ for the relay 12 act for instantaneous operating contacts and the output terminals $a_2$, $b_2$ and $c_2$ for the relay 14 act for timed operating contacts.

Figure 5B:
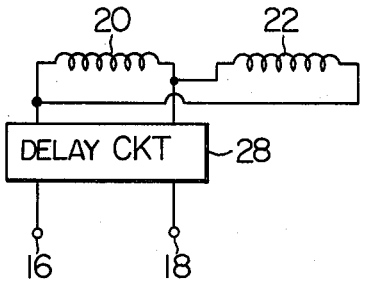

Alternatively, the power supply terminals 16 and 18 may be connected, as shown in FIG. 5B, across a parallel circuit of the exciting coils 20 and 22 of the respective relays 12 and 14 through the delay circuit 28, so that both the output terminals $a_1$, $b_1$, $c_1$; and $a_2$, $b_2$, $c_2$ act for simultaneous timing contacts.

Figure 5C:
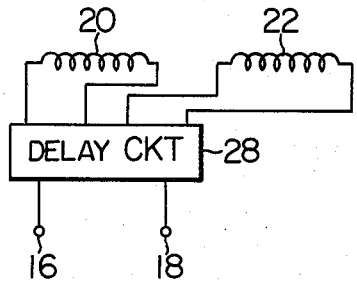

Alternatively, the power supply terminals 16 and 18 may be connected, as shown in FIG. 5C, across two timing circuits, one comprising a combination of the exciting coil 20 of the relay 12 and a part of the delay circuit 28, and the other comprising a combination of the exciting coil 22 of the relay 14 and another part of the delay circuit 28, so that the output terminals $a_1$, $b_1$, $c_1$ and $a_2$, $b_2$, $c_2$ function for two different timed operating contacts.

Figure 3B:
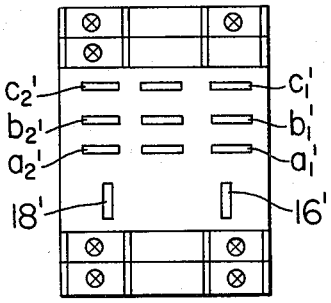
FIG. 3B is a front side view of a conventional three-pole relay socket into which the embodiment of FIG. 1 is adapted to be inserted.
Figure 3A:
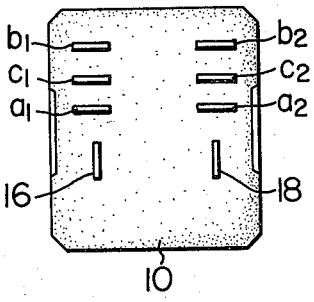
FIG. 3A is a back side view of the embodiment of FIG. 1.
Figure 4:
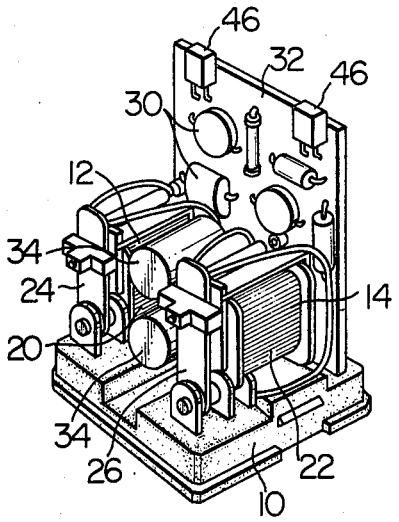
FIG. 4 is a perspective view showing the essential parts of the embodiment of FIG. 1.

If the output terminals $a_1$, $b_1$, $c_1$ and $a_2$, $b_2$, $c_2$ for the relays 12 and 14 are disposed so as to match selected two, preferably outside two, of three arrays of terminal insertion holes of an ordinary three-pole relay socket as shown in FIG. 3B, it is not necessary to prepare a special socket for the electronic timer according to the invention. By arranging the output terminals $a_1$, $b_1$, $c_1$ and $a_2$, $b_2$, $c_2$ to match the outside two of the three arrays of the terminal insertion holes of an ordinary three-pole relay socket, a space is available between the two juxtaposed relays 12 and 14 and may be occupied by comparatively large parts as described above. FIG. 3B shows an ordinary three-pole relay socket of the type previously mentioned, having three arrays of terminal insertion holes, the outer two arrays $a_1'$, $b_1'$, $c_1'$ and $a_2'$, $b_2'$, $c_2'$ of which correspond respectively to the output terminals $a_1$, $b_1$, $c_1$ and $a_2$, $b_2$, $c_2$ of the timer as shown in FIG. 3A. Holes 16' and 18' are provided for receiving the power input terminals 16 and 18 of the timer.

In the vicinity of the upper end of the printed base 32, light-emitting diode display units 46 for indicating the timer operating condition to the outside are preferably mounted.

Figure 6:
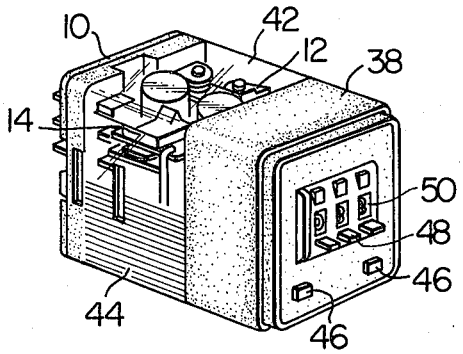
FIG. 6 is a perspective view showing another embodiment of the present invention of the digital timing setting type.

The embodiment shown in FIG. 6 is not of the pointer type as shown in FIG. 1 but of the digital display type. In the embodiment under consideration, the timing is set by depressing the desired one of the push buttons 48 and displayed digitally through the windows 50.

It will be understood from the foregoing description that according to the present invention meritorious effects are shown in that the two electromagnetic relays 12 and 14 and the delay circuit 28 are arranged on the same base and the output terminals $a_1$, $b_1$, $c_1$; and $a_2$, $b_2$, $c_2$ for the relays 12 and 14 and the power supply terminals 16 and 18 are led out, thereby easily providing an electronic timer with the above-mentioned construction of contacts, and eliminating the use of two independent units of a timer and relays on the one hand and saves the space on the other hand. Further, the lead-out terminals on the lower part of the timer may be arranged, as shown in FIG. 3, so as to be equivalent to those of a three-pole relay, without the central output terminal arrays, thus making it possible to use an ordinary three-pole relay socket. Furthermore, the resulting space available between the relays 12 and 14 may be used to accommodate comparatively large electronic parts.

We claim:

1. An electronic timer apparatus, comprising:

an electrically insulating base having upper and lower surfaces;

first and second electromagnetic relays secured on said upper surface of said base, each relay comprising an exciting coil and contact means at one of the opposite ends of said exciting coil, said relays being spaced from each other and in the same orientation on said upper surface;

a delay circuit comprising a plurality of electrical parts, at least one of which electrical parts is comparatively large;

means extending from said first surface for supporting said delay circuit adjacent to the other of said opposite ends of said exciting coils with said at least one comparatively large electrical part extending into the space defined between said first and second electromagnetic relays;

first and second output terminal means connected to the respective contact means of said first and second relays and extended from said lower surface of said base;

external power supply connection terminal means also extended from said lower surface and adapted to be connected to an external power supply for energizing a timer circuit comprising said exciting coils and said delay circuit; and a casing disposed in engaged relation with said base to cover said first and second relays and said delay circuit.

2. An electronic timer according to claim 1, in which the exciting coil of said first relay is connected directly to aid external power supply connection terminal means, and the exciting coil of said second relay is connected through said delay circuit to said external power supply connection terminal means.

3. An electronic timer according to claim 1, in which the respective exciting coils of said first and second relays are connected in parallel to said external power supply connection terminal means so that said first and second relays are simultaneously operated with a predetermined delay time.

4. An electronic timer according to claim 1, in which the respective exciting coils of said first and second realys are connected through said delay circuit to said external power supply connection terminal means so that said first and second relays are operated with predetermined and different delay times.

5. An electronic timer according to claim 1, in which means for setting the timing is included in said parts and is mounted on the surface of said casing, so that a given timing may be set from outside said timer.

6. An electronic timer according to claim 1, in which said first and second output terminal means are adapted for insertion into two of the three arrays of terminal insertion holes of an external three-pole relay socket, so that said electronic timer is of the plug-in type.

7. An electronic timer according to claim 6, in which said first and second output terminal means are adapted for insertion into the outer two of the three arrays of terminal insertion holes of an external three-pole relay socket.

* * * * *